US008505779B2

(12) United States Patent
Lilienthal et al.

(10) Patent No.: US 8,505,779 B2
(45) Date of Patent: Aug. 13, 2013

(54) CAP FOR AN ATOMISER

(75) Inventors: Hans Peter Lilienthal, Hamburg (DE); Herve Bodet, Verdun (FR)

(73) Assignee: Lindal France SAS, Briey (FR)

( * ) Notice: Subject to any disclaimer, the term of this patent is extended or adjusted under 35 U.S.C. 154(b) by 804 days.

(21) Appl. No.: 12/593,446

(22) PCT Filed: Mar. 20, 2008

(86) PCT No.: PCT/EP2008/053368
§ 371 (c)(1),
(2), (4) Date: Jan. 27, 2010

(87) PCT Pub. No.: WO2008/125416
PCT Pub. Date: Oct. 23, 2008

(65) Prior Publication Data

US 2010/0155427 A1 Jun. 24, 2010

(30) Foreign Application Priority Data

Mar. 26, 2007 (FR) ..... 07 02182
Mar. 27, 2007 (FR) ..... 07 02207
Mar. 28, 2007 (FR) ..... 07 02372

(51) Int. Cl.
*B65D 83/22* (2006.01)

(52) U.S. Cl.
USPC ..... 222/182; 222/402.13; 222/153.01

(58) Field of Classification Search
USPC ..... 222/556, 402.11, 182, 402.13, 153.01, 222/207, 553; 220/254.3
See application file for complete search history.

(56) References Cited

U.S. PATENT DOCUMENTS

| | | | | |
|---|---|---|---|---|
| 3,752,371 | A | 8/1973 | Susuki et al. | |
| 4,310,105 | A * | 1/1982 | Gach | 222/153.02 |
| 5,699,912 | A * | 12/1997 | Ishikawa et al. | 206/494 |
| 6,991,138 | B2 * | 1/2006 | Marroncles | 222/402.11 |
| 2005/0029266 | A1 * | 2/2005 | Ziegenhorn et al. | 220/256.1 |
| 2005/0133475 | A1 * | 6/2005 | Goto et al. | 215/237 |

(Continued)

FOREIGN PATENT DOCUMENTS

| | | | |
|---|---|---|---|
| EP | 1780141 | A1 | 5/2007 |
| JP | 57-9268 | Y2 | 2/1982 |

(Continued)

OTHER PUBLICATIONS

International Search Report of PCT/EP2008/053368, Mailing Date of Jun. 23, 2008.

(Continued)

*Primary Examiner* — Paul R Durand
*Assistant Examiner* — Charles P Cheyney
(74) *Attorney, Agent, or Firm* — Westerman, Hattori, Daniels & Adrian, LLP

(57) ABSTRACT

The invention relates to a cap comprising a base with means for fixing it to a container, a top fixed to the base by a hinge, closure means consisting of a first closure means and a second closure means, one on the base and the other on the top, the closure means working together to keep the top in a first position in which it is closed against the base, release means for moving apart from each other the first closure means and the second closure means and means for lifting the top. In accordance with the invention, the means for lifting the top consist of at least one leaf spring, one of whose ends is fixed to the base and the other of whose ends is able to slide on the bowl of the top, the leaf spring being under tension when the top is closed, and being relaxed or partially relaxed when the top is in the fully open position. This cap is particularly intended for use as a spray head for a spray device.

7 Claims, 5 Drawing Sheets

(56) References Cited

U.S. PATENT DOCUMENTS

Figure 8:
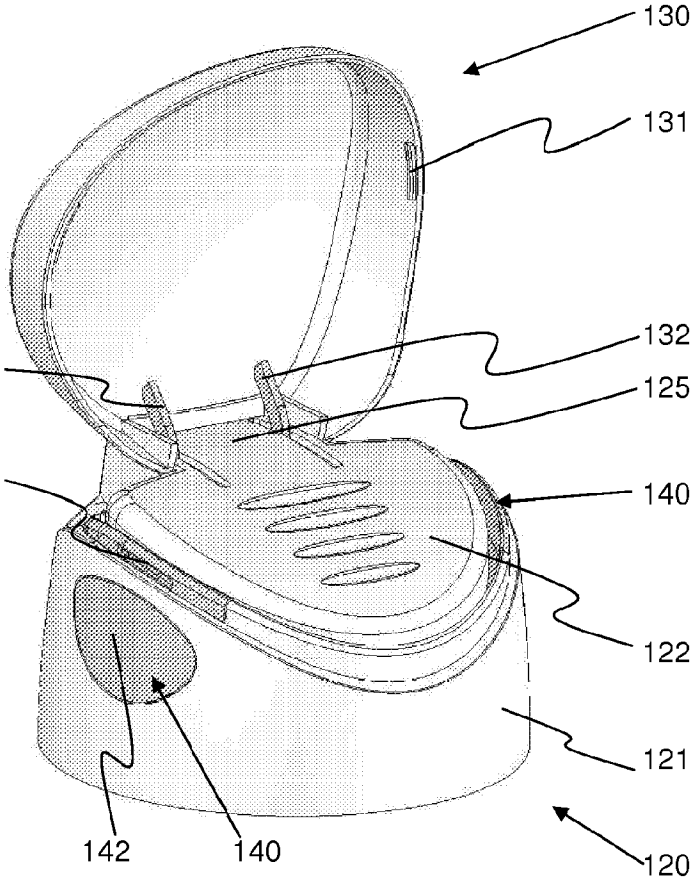

| | | | | |
|---|---|---|---|---|
| 2005/0205607 | A1* | 9/2005 | Hierzer et al. | 222/153.1 |
| 2006/0108364 | A1* | 5/2006 | Benktzon et al. | 220/324 |
| 2007/0095864 | A1 | 5/2007 | Vangeel et al. | |
| 2008/0023477 | A1* | 1/2008 | Markert | 220/259.1 |
| 2008/0245795 | A1* | 10/2008 | Berge | 220/264 |

FOREIGN PATENT DOCUMENTS

| | | | |
|---|---|---|---|
| JP | 63-99847 | U | 6/1988 |
| JP | 8-40451 | A | 2/1996 |
| JP | 2003-54601 | A | 2/2003 |
| JP | 2004-352307 | A | 12/2004 |
| WO | 03/084835 | A1 | 10/2003 |
| WO | 2004/041671 | A1 | 5/2004 |

OTHER PUBLICATIONS

Japanese Office Action dated Oct. 2, 2012, issued in corresponding Japanese patent application No. 2010-500233, w/ partial English machine-translation.

* cited by examiner

A
B
A-A
B-B
E
210
220
221
222
223
224
225
229
230
231
232
240
241

CAP FOR AN ATOMISER

The invention concerns a cap according to the precharacterising clause of claim 1. This cap is particularly intended to serve as an atomisation head for a spray.

Diffusers generally consist of a bottle provided with an aerosol valve and a cap provided with a push button for actuating the bottle valve. In order to prevent the push button being actuated inadvertently, it is usual to provide means of locking the push button. Another solution consists of making it accessible only at the time of use. For this purpose, a lid is provided on the base of the cap in order to conceal the atomisation head. This lid is fixed to the base by a hinge. Means are provided for holding the lid closed against the base, thus making the push button inaccessible. A bonnet provided on the lid, opposite to the hinge, makes it possible to open the lid by exerting an upward pressure.

If the means for holding the lid are too flexible, the latter may open too easily, even when this is not desirable. If on the contrary they are too rigid, the user risks having difficulty in lifting the lid by means of the bonnet and risks damaging their nails.

The bonnet as release means has the drawback of projecting beyond the envelope of the base. It therefore risks being caught during transportation or carrying, for example in a toilet bag or in a handbag, and the lid risks opening inadvertently in the bag at the risk of having the content of the bottle spilling therein.

From the document JP 2004352307 A, a cap is known comprising a base and a lid fixed to the base by a hinge. The lid can be held in the closed position by hooks situated on the base and cooperating with recesses produced in the lid. The base is provided with a spray nozzle and the lid with a sealing cylinder intended to cover the spray nozzle when the lid is closed. To facilitate the opening of the lid when the closure means are released, a flexible blade has been provided, one of the ends of which is fixed to the spray nozzle and the other end of which bears against the cylinder covering the spray nozzle. This flexible blade has numerous drawbacks. For example, if the lid is excessively folded down in the open position, the end of the blade that bears against the sealing cylinder risks moving away from it and not returning to its place when the lid is closed. To prevent this problem, it would be possible to give the blade sufficient length so that it always remains in contact with this cylinder but, in this case, it risks not longer being able to fold correctly in the closed space situated between the base and the closed lid. Another drawback stems from the fact that, in the closed position, this blade is practically entirely folded on itself. Such a blade could not be used for a pressurised bottle since it would risk bearing on the push button when the lid is closed and thus holding the valve open throughout the closure of the lid, which obviously is the contrary to the effect sought. Finally, here again, the release means project beyond the envelope of the cap and risk being actuated accidently during storage.

The document JP 2003054601 discloses a device to be placed on a drinks bottle. The lid part, to be fixed to the face of the bottle provided with the opening, is provided with a base, a lid connected to the base by a hinge and means for holding the lid in the closed position. To facilitate the opening of the lid when the release means are actuated, a straw mounted on a spring has been provided. One of the ends of the straw is immersed in the bottle while the other end bears against a curved insert fixed at the centre of the lid when the latter is in the closed position. These means for lifting the lid are particularly complicated and have recourse to numerous parts. They are much too expensive to be employed on a single-use bottle. In addition, this straw on a spring bears on the front face of the base. This device for lifting the lid could therefore not be used with a cap for an atomiser. This is because this straw would bear on the push button and would trigger the atomisation as long as the lid is closed, which is contrary to the effect sought. Another drawback lies in the fact that the end of the straw that is to enter the mouth of the user, and which consequently keeps remains of drinks and saliva, bears against the bottom of the lid. Finally, here also, the release means project beyond the envelope of the base and therefore risk being actuated inadvertently during transportation or storage.

From the document JP 09142511 a cap provided with a base, a lid and means for holding the lid in the closed position is known. In addition, there have been provided firstly two vertical leaf springs on the base close to the hinge and secondly two ribs inside the lid facing the leaf springs. When the lid is folded down on the base, the ribs come to bear on the flat of the leaf springs and curve them. However, it is seen on one of the cross sections that these leaf springs form only a single piece with the cap and are produced from the same material as the rest of the said cap. In other words, these leaves are manufactured from the same material as the base, in general polypropylene (PP) or polyethylene (PE). In all cases, these materials do not have shape memory and deform irreversibly if they are subjected to such a curving. The result is that the means for lifting the lid proposed by this document cannot function more than once or twice, the leaves not returning to their initial vertical position after having been kept curved. In addition, because of the use of the ribs, the leaf springs have a necessarily short length, which greatly limits their efficacy. Finally, here again, the release means completely project beyond the base and therefore risk being actuated inadvertently.

The objective of the invention is to facilitate the opening of the lid by means for lifting it which do not have the drawbacks mentioned above. Another object of the invention is to provide release means that do not risk being activated inadvertently during transportation or storage.

This objective is achieved in accordance with the invention because the means for lifting the lid consist of at least one leaf spring, one of the ends of which is fixed to the base and the other end of which can slide on the bottom of the lid, the leaf spring being in the tensioned position when the lid is folded down and in the relaxed or partially relaxed position when the cap is in the wide-open position. The second end of the leaf spring sliding on the bottom of the lid, the leaf can be relatively long and therefore does not need to be as curved as in the prior art.

It is particularly advantageous for the leaf spring or springs to be produced from a different material from the base, the base preferably being produced from polypropylene (PP) or high- or low-density polyethylene (HDPE, LDPE) and the leaf spring or springs preferably from a plastics material with a good shape memory, such as polyoxymethylene (POM), polyamide (PA) or polypropylene terephthalate (PPT). Thus a first material will be chosen for the base and the lid that will be relatively rigid (in order to obtain or ensure a secure assembly between the said piece and the aerosol bottle or can), the mechanical properties of which will be adapted for producing the hinge. For the leaves, on the other hand, a more flexible material will be chosen with a good shape memory.

In practice, the leaf spring or springs can be moulded onto the base. It is also possible for the leaf springs to be parts distinct from the base on which they are fixed by mechanical anchoring means. It may be a case for example of undercuts or attachment joints.

In order to elongate the leaf spring or springs further, it is preferable to fix the leaf spring or springs in the bottom part of the base opposite to the lid, slots being able to be produced in the front surface of the base when the latter is provided with such a front surface in order to allow the leaf spring or springs to pass. In concrete terms, the first end is fixed to the base below the front surface of the base, the leaf passes through the slot and comes to bear on the bottom of the lid when the latter is folded down. The length of the slots is chosen so that the leaf can curve freely without being interfered with by the slot. The longer the leaf, the better is the spring effect and the lower is the tension to which it is subjected when the lid is closed. In addition, the longer the leaf, the longer the contact between it and the lid, which improves the guidance of the latter. It is also possible for the leaf springs to pass on each side of the front surface of the base.

It is preferable to place the release means in the base or in the lid so as not to project beyond the envelope thereof. Envelope means the virtual geometric surface defined by the external wall of the base or of the lid while respecting the general geometry of the latter. The release means are therefore placed so that they do not project beyond the location that the base or lid would have if they had not been present.

In a particularly advantageous embodiment, the first and second closure means consist of a first shoulder and a second shoulder, one of the shoulders at least being placed on a support having a certain elasticity so that, during the folding-down movement of the lid, the flexible support moves away perpendicularly to the approach movement of the two shoulders to allow the passage of the other shoulder until the two shoulders fit one behind the other, enabling the support to at least partially return to its initial position.

In a first variant embodiment of the invention, the release means are formed by means for moving the first and second closure means away from each other parallel to the wall of the base or of the lid.

It is preferable for the means for moving away the closure means parallel to the wall of the base or of the lid to be formed by a plate on which the first or second closure means is fixed, the said plate being able to be moved with respect to the base or to the lid in a movement parallel to the wall thereof between a first position in which the two closure means cooperate in order to keep the lid folded down when the latter is folded down and a second position in which the two closure means no longer cooperate when the cap is folded down, a spring preferably being provided for automatically returning the plate, in the absence of external forces, to the first position.

A practical solution consists of designing the plate in the form of a ring, one section at least of which is placed on a part at least of the circumference of the base, outside the area covered by the lid when the latter is folded down, the ring being able to slide against the base, part of the ring being able to fulfil the function of return spring.

In a second variant embodiment of the invention, the release means are formed by means for moving away the first and second closure means perpendicular to the base or to the lid.

For this purpose, it is advantageous for the perpendicular separation means to be formed by means for exerting a pressure on the elastic leaf from the outside of the lid.

It is in accordance with the invention to place the release means on an attached piece placed on the base or on the lid.

In a first version of this second variant embodiment, the closure means and the release means are placed opposite to the hinge.

In a second version of this second variant embodiment, the cap is provided with two sets of closure means and two release means placed symmetrically on each side of the mid-plane passing through the centre of the hinge.

The cap according to the invention is particularly well suited to a pressurised bottle. In this case, it is provided with a push button placed on the base in the area that can be covered by the lid when it is folded down, the push button being able to be provided with means for actuating a valve situated on the receptacle on which the cap can be placed, the base also being able to comprise a channel for transmitting the product emerging from the valve of the receptacle when it is actuated by the means of actuating the push button.

Figure 1:
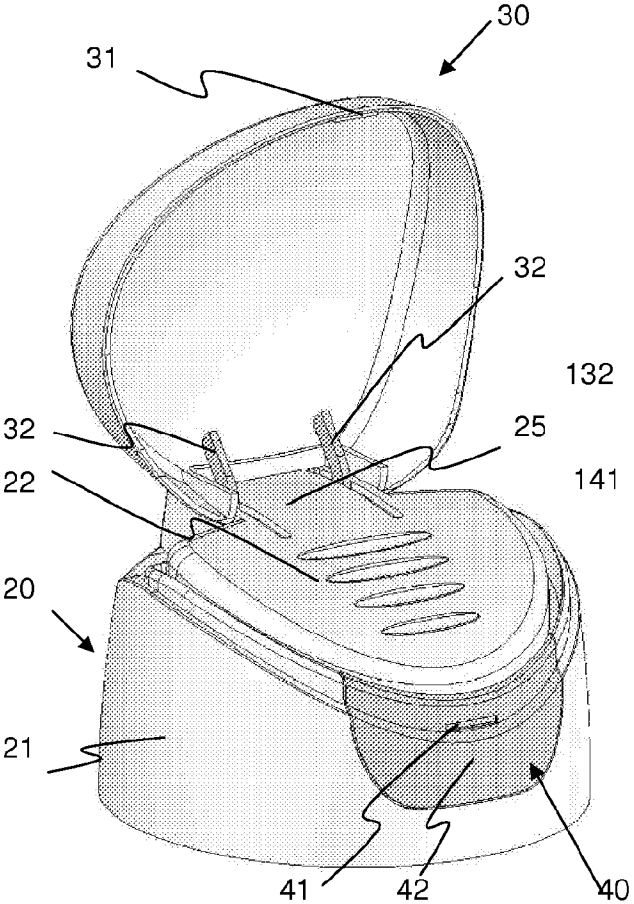
Figure 6:
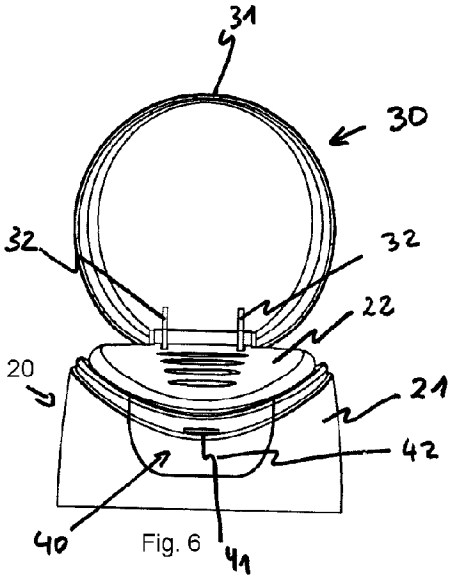
Figure 7:
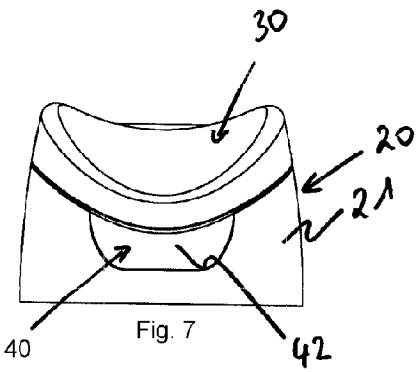
Figure 4:
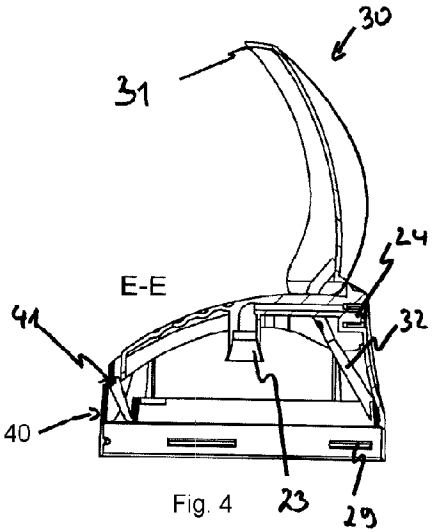
Figure 5:
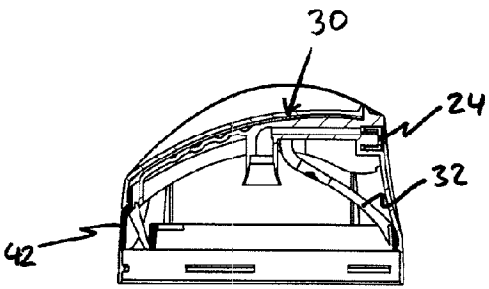
Figure 2:
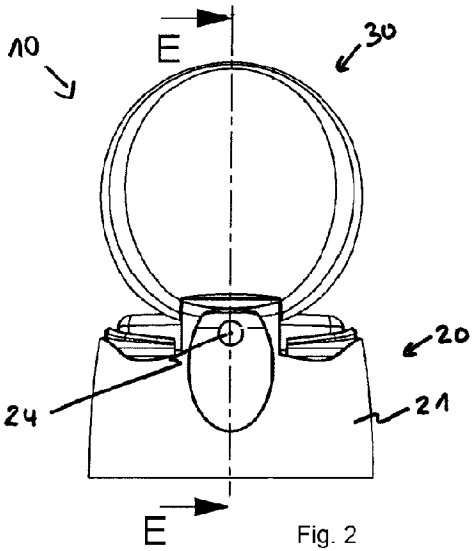
Figure 3:
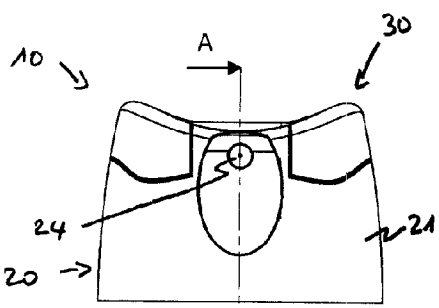
Figure 9:
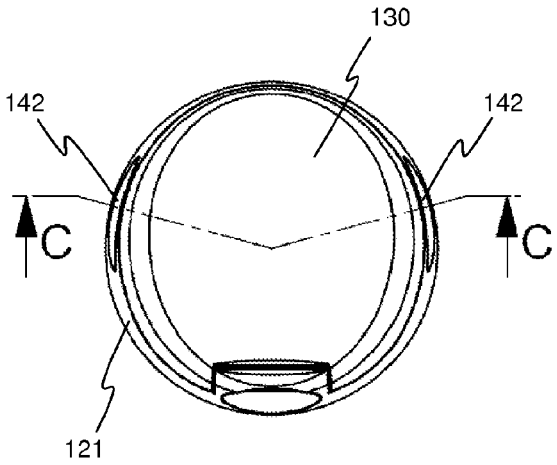
Figure 11:
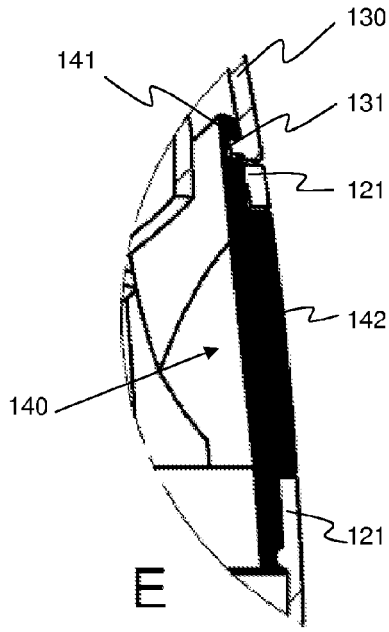
Figure 10:
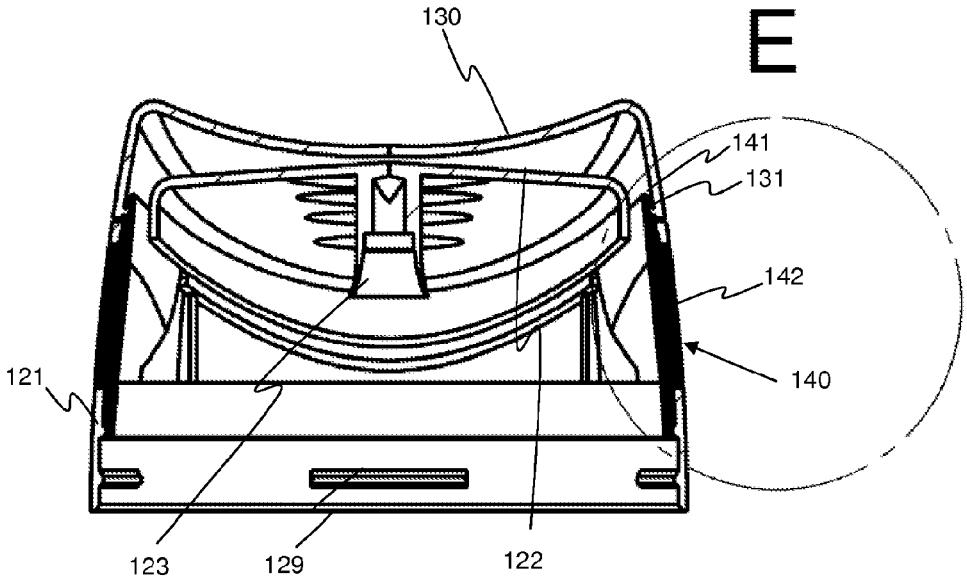
Figure 13:
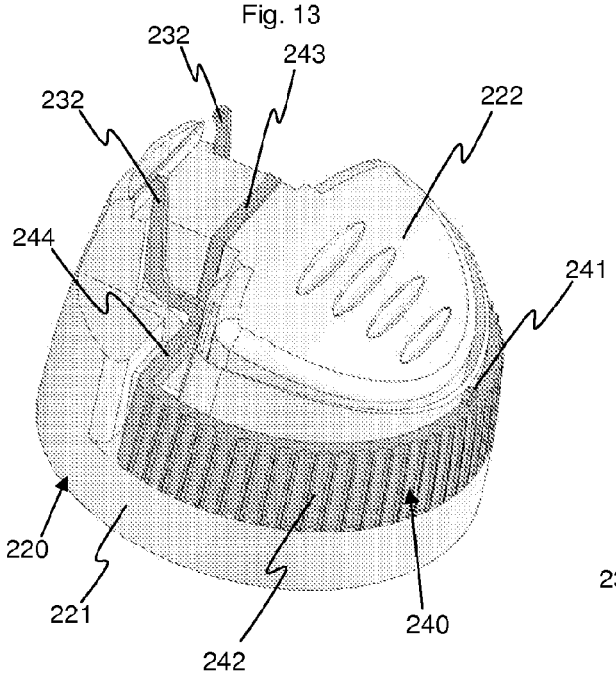
Figure 12:
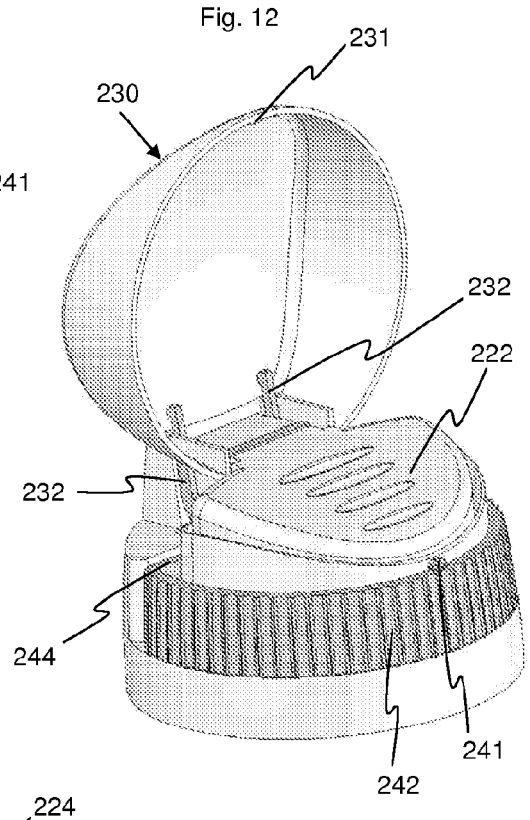
Figure 14:
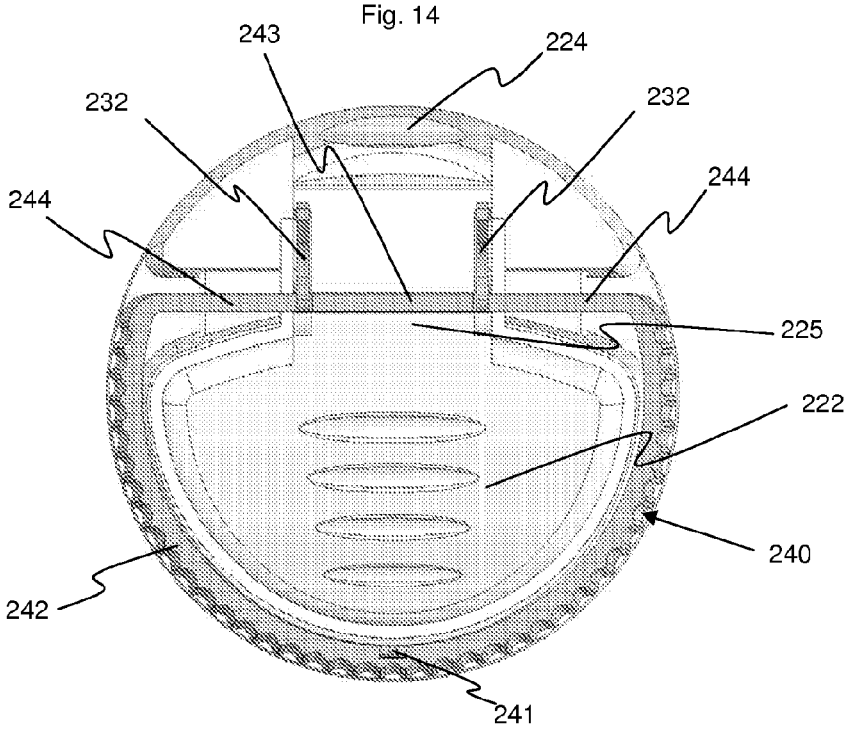
Figures 15, 16, 17, 18, 19, 20:
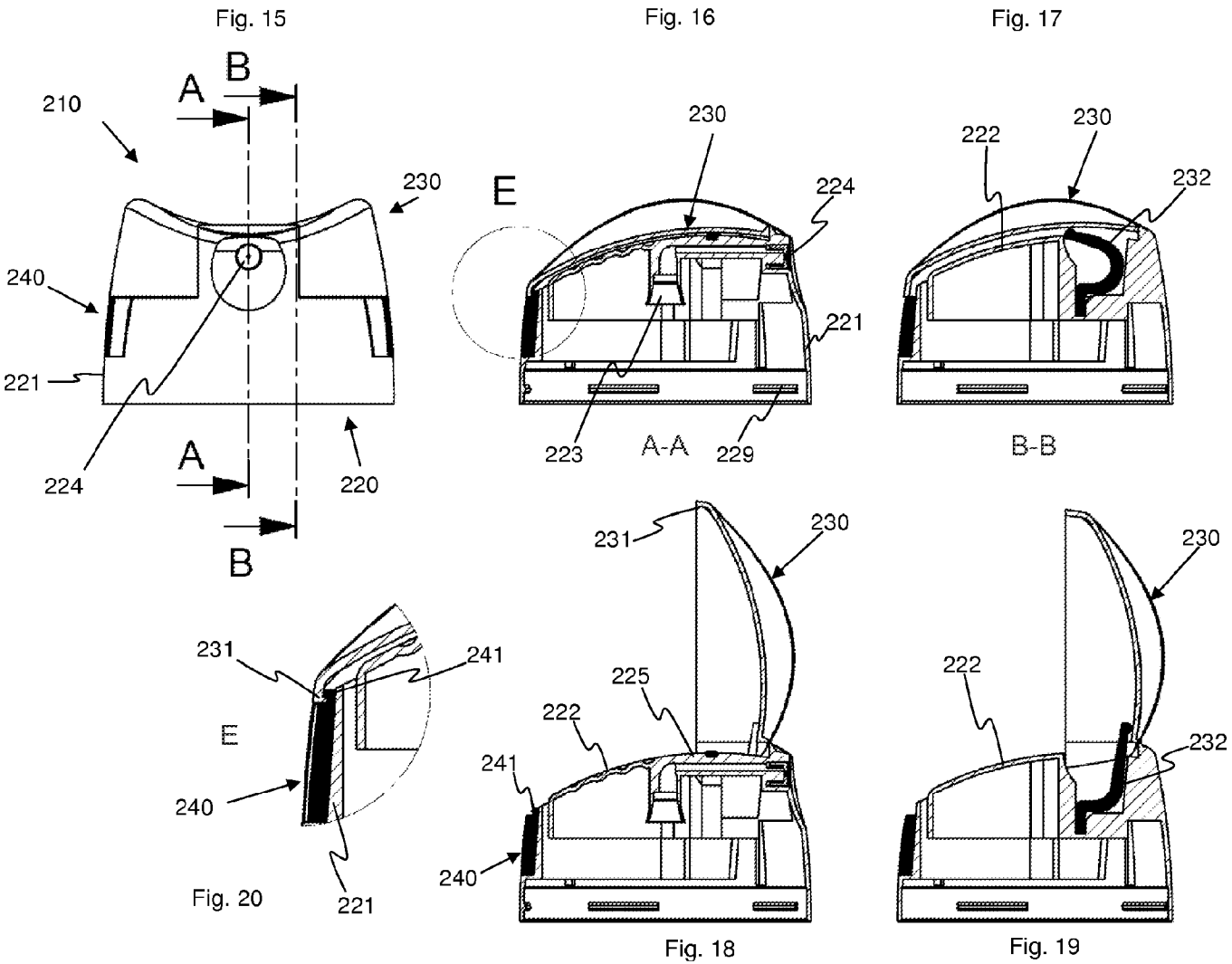

The invention is described in more detail with the help of two example embodiments presented in the following figures:

FIG. 1: perspective view of a first embodiment, the lid being in the open position;

FIG. 2: front view of the cap of FIG. 1, the lid being in the open position;

FIG. 3: front view of the cap of FIG. 1, the lid being closed;

FIG. 4: view in median section along the section E-E in FIG. 2, the lid being open;

FIG. 5: view in median section along the section A-A in FIG. 3, the lid being closed;

FIG. 6: back view of the cap of FIG. 1, the lid being in the open position;

FIG. 7: back view of the cap of FIG. 1, the lid being closed;

FIG. 8: perspective view of a second embodiment, the lid being in the open position;

FIG. 9: plan view of the cap of FIG. 8;

FIG. 10: view in section along the section C-C in FIG. 9, the lid being closed;

FIG. 11: enlargement E in FIG. 10;

FIG. 12: perspective view of a third embodiment, the lid being open;

FIG. 13: perspective view of the base, the ring and the leaf springs of the cap of FIG. 12, the lid being removed;

FIG. 14: plan view of the cap of FIG. 12, the lid being removed;

FIG. 15: front view of the cap of FIG. 12, the lid being closed;

FIG. 16: view in median section along the section AA in FIG. 15, the lid being closed;

FIG. 17: view in section along the section BB in FIG. 15, the lid being closed;

FIG. 18: view in median section along the section AA in FIG. 15, the cap being open;

FIG. 19: view in median section along the section BB in FIG. 15, the lid being open;

FIG. 20: enlargement E in FIG. 16.

FIGS. 1 to 11 present two variants of the same example embodiment. These two variants are very similar: the first is provided with a single set of closure means and release means, disposed substantially opposite the hinge, while the second is provided with two sets disposed symmetrically with respect to the mid-plane passing through the hinge. FIGS. 12 to 20 present a second example embodiment.

The cap (10, 110, 210) is composed of a base (20, 120, 220) and a lid (30, 130, 230) fixed to the base (20, 120, 220) by a hinge.

The cap is intended to be placed on the top of a pressurised receptacle provided with an aerosol valve (not shown). For this purpose fixing means (29, 129, 229) are provided on the base (20, 120, 220).

The base (20, 120, 220) comprises essentially a substantially cylindrical part (21, 121, 221) closed on the top by a push button (22, 122, 222) forming the front face. The push button is provided with means (23, 123, 223) for actuating the aerosol valve of the receptacle on which the cap will be mounted. These actuation means (23, 123, 223) are continued by a channel and an atomisation nozzle (24, 124, 224). The push button (22, 122, 222) is connected to the rest of the base (20, 120, 220) only by the tongue (25, 125, 225) situated on the same side as the nozzle (24, 124, 224) so that it is possible, by exerting a pressure on top, to move the actuation means (23, 123, 223) downwards and thus to the actuate the valve.

The lid (30, 130, 230) is connected to the base (20, 120, 220) by a hinge, which enables it to move between a position entirely folded down on the base (20, 120, 220), thus retracting the push button (22, 122, 222), and a wide-open position in which the user can access this push button (22, 122, 222). This hinge can be designed so it has itself a small spring effect so that, as soon as a certain angle of opening is achieved, it tends to move the lid into a wide-open position.

The base (20, 120, 220) and the lid (30, 130, 230) are produced for example from polypropylene (PP) or high- or low-density polyethylene (HDPE, LDPE).

In order to provide automatic opening of the lid (30, 130, 230) as soon as the release means are actuated, two leaf springs (32, 132, 232) have been provided, one of the ends of which is fixed to the cylindrical part (21, 121, 221) of the base and the other end of which can slide on the internal face of the lid (30, 130, 230). The leaf springs (32, 132, 232) pass on each side of the tongue (25, 125, 225) connecting the push button (22, 122, 222) to the base (20, 120, 220). These leaf springs (32, 132, 232) are in a tensioned position when the lid (30, 130, 230) is folded down on the base (20, 120, 220) and in the relaxed or in any event less tensioned position when the lid (30, 130, 230) is in the wide-open position. By placing the first end of the leaf springs below the front surface (22, 122, 222) in the bottom part of the base, it is possible to increase accordingly the length of the blade so that the latter is even more effective while being subjected to lesser tensions. By virtue of the slots (26, 126), the push button (22, 122) covers practically the entire transverse section of the base (20, 120). The slots (26, 126) are sized so that the leaves (32, 132) have great freedom to flex under the effect of the lid folding down.

The leaves (32, 132, 232) are preferably produced from a material with a good shape memory, such as polyoxymethylene (POM), polyamide (PA) or polypropylene terephthalate (PPT). They can be moulded onto the base using mechanical anchorings (undercuts or anchoring joint) when the material used for the base and that used for the leaves are not compatible. It is also possible for these leaves to be separate parts, distinct from the base, and for them to be fixed to the latter by appropriate means.

Since the leaves slide on the bottom of the lid, they do not risk losing contact with a particular support point as in the document JP 2004352307. Even if they lose contact with the bottom of the lid when the latter is wide open, they will regain contact at the point that they had left when the lid is folded down. In addition, if ever they deformed a little with time, they would continue to come into contact with the bottom of the lid at a point slightly moved with respect to the initial contact point.

Closure means are provided on the lid (30, 130, 230) and on the base (20, 120, 220). They are formed by a first shoulder (31, 131, 231) situated on the internal face of the lid (30, 130, 231) and by a second shoulder (41, 141, 242) situated at the cylindrical part (21, 121, 221) of the base (20, 120, 220).

In a first embodiment, this second shoulder (41, 141) is placed on a leaf (40, 140) with a certain elasticity, slightly inclined with respect to the relative movement of the first shoulder (31, 131) when the lid (30, 130) is closed. In addition, the first shoulder or shoulders (31, 131) are preceded by an inclined surface that further facilitates the coming into contact of the part of the lid carrying the first shoulder (31, 131) with the part of the leaf (40, 140) carrying the second shoulder (41, 141). Thus, when the lid (30, 130) is folded down on the base (20, 120), the inclined face preceding the first shoulder (31, 131) comes into contact with the leaf (40, 140), slides against it while slightly moving it away towards the inside of the cap (10, 110) until the first shoulder (31, 131) passes behind the second shoulder (41, 141), enabling the leaf (40, 140) to return to its initial position, or at least to move close to it. In this position, it is no longer possible to open the lid, the two shoulders (31/41, 131/141) cooperating together. The elasticity of the leaf (40, 140) is chosen so as to provide automatic closure of the lid (30, 130) when this is folded down on the base, without for all that offering excessive resistance. It goes without saying that the inclined surface can be placed in front of the first shoulder and/or in front of the second shoulder.

In its part opposite the shoulder (41, 141), the leaf (40, 140) is fixed to the cylindrical part (21, 121) of the base (20, 120). It therefore suffices, to release the two shoulders (31/41, 131/141), to press on the leaf in order to move the second shoulder (41, 141) away from the first shoulder (31, 131) by applying to it a movement substantially perpendicular to the base, in the direction of the centre of the cap. In the examples presented here, the leaves are attached pieces embedded in the base (20, 120). It can also be envisaged that they form only one piece with the part of the cylindrical part (21, 121) of the base while being produced either from the same material or from another material by moulding on. In a particular embodiment of the invention, these leaves (40, 140) are produced from a flexible material with a good shape memory, such as polyoxymethylene (POM), polyamide (PA) or polypropylene terephthalate (PPT).

In the first variant, the cap is provided with only one leaf (40) and a single set of shoulders (31, 41). This leaf (40) is situated opposite the hinge of the lid (30).

In the second variant, the cap is provided with two leaves (140) each carrying a shoulder (141), the lid (130) comprising two corresponding shoulders (131) on its internal face. These two leaves (140) and the corresponding shoulders (131) are situated symmetrically with respect to the mid-plane of the cap passing through the centre of the hinge. For reasons of stability, the cylindrical part (121) of the base (120) partially covers the leaves (140).

As can be seen, the closure means (41, 141) and the release means (40, 140) resume their initial position as soon as the pressure exerted on the release means formed by the blade or blades (40, 140) ceases.

As soon as a pressure is exerted on the leaf or leaves (40, 140), the two shoulders cease to cooperate and the two leaf springs (32, 132) separate the lid (30, 130) from the base (20, 120) as far as the wide-open position, in which it is held by the leaf springs (32, 132). When the user folds the lid (30, 130) on the base against the spring effect of the leaf spring or springs (32, 132), the shoulders (31/41, 131/141) come into engagement and hold the lid (30, 130) in the folded position.

In a second embodiment (210), the second shoulder or shoulders (241) are placed not on a flexible leaf but on a plate (240) that can be moved tangentially to the base and parallel to the shoulders (231, 241) until these can no longer cooperate together. In the example presented here, this plate consists of a ring (240) partly surrounding the base (220) of the cap (210) below the lid (230) when it is in the folded-down position. Seen from above, this ring (240) has an annular shape, a large part of which (242) bears on a part of the circumference of the base (220) and is always accessible to the user. The other part (243, 244) is substantially perpendicular to the mid-plane of the base passing through the middle of the hinge and situated inside the cap. The centre (243) of this internal part is wedged in a groove while its ends (244) are not interfered with and form a flexion zone allowing a small circular movement of the ring (240) about its central stable position. Thus, when the user slides the external part (242) of the ring (240) against the base (220) towards the right or towards the left in a movement tangential to the base (220) and parallel to the shoulders (231, 241), it causes the sliding of the shoulders one on the other. By virtue of the leaf springs (232), the lid (230) lifts as soon as the two shoulders (231, 241) are no longer aligned. After the user has released the ring (240), the latter automatically returns to its central equilibrium position under the spring effect of the external zones (244) of the ring (240). To allow automatic closure of the lid (230) when the user folds it against the base (220), provision is made for the part of the lid (230) that carries the first shoulder (231) to be sufficiently flexible to move away slightly when the first shoulder (231) slides against the appendage of the ring (240) that carries the second shoulder (241), until it projects beyond the latter and the two shoulders cooperate once again. Unlike the previous embodiments, it is not the support of the second shoulder that yields in order to allow the first to pass, but the support of the first shoulder that yields in order to allow the sliding of the two shoulders one towards the other. This is because, in this embodiment, the ring is in abutment against the base, which was not the case with the end of the leaves (40, 140) of the previous examples.

In the two embodiments, the release means, formed by the flexible leaf or leaves (40, 140) or by the annulus (240), are always in line with the external wall of the base so that they do not project beyond it. There is no discontinuity in the geometric shape of the base when the flexible leaves or the annulus pass. This can be seen particularly well in the perspective views in FIGS. 1 and 8 and on the sections in FIGS. 11, 16 and 20. These release means risk less being actuated inadvertently during transportation or storage of the product. They do not risk hooking onto a projecting object.

Although the examples presented or mentioned here make provision for putting the release means (40, 140, 240) on the base, it can be entirely envisaged putting them on the lid. Likewise, the leaf springs (32, 132, 232) could be fixed to the lid and slide on the internal surface of the base. Any other spring system could also be provided.

LIST OF REFERENCES

| 1st embodiment | | | |
|---|---|---|---|
| 1st variant | 2nd variant | 2nd embodiment | Item |
| 10 | 110 | 210 | Cap |
| 20 | 120 | 220 | Base |
| 21 | 121 | 221 | Cylindrical part |
| 22 | 122 | 222 | Push button |
| 23 | 123 | 223 | Actuation means |
| 24 | 124 | 224 | Outlet nozzle |
| 25 | 125 | 225 | Tongue |
| 26 | 126 | | Slots |
| 29 | 129 | 229 | Fixing means |
| 30 | 130 | 230 | Lid |
| 31 | 131 | 231 | First shoulder |
| 32 | 132 | 232 | Leaf springs |
| 40 | 140 | | Leaf |
| 41 | 141 | | Second shoulder |

-continued

| 1st embodiment | | | |
|---|---|---|---|
| 1st variant | 2nd variant | 2nd embodiment | Item |
| 42 | 142 | | Pusher |
| | | 240 | Ring |
| | | 241 | Second shoulder |
| | | 242 | External part |
| | | 243 | Locked internal part |
| | | 244 | Flexible internal part |

The invention claimed is:

1. Cap comprising:

a base provided with means for fixing it to a receptacle, a lid fixed to the base by a hinge, closure means consisting of a first closure means and a second closure means, one situated on the base and the other on the lid, the closure means cooperating together in order to hold the lid in a first position folded down on the base, release means for separating from each other the first closure means and the second closure means, and means for lifting the lid, the release means and the means for lifting the lid being distinct from each other, wherein the means for lifting the lid are formed by at least one leaf spring, one of the ends of which is fixed to the base and the other end of which can slide on the bottom of the lid, the leaf spring being in the tensioned position when the lid is folded down and in the relaxed or partially relaxed position when the lid is in the wide-open position, wherein the means for moving the closure means away parallel to the wall of the base or of the lid are formed by a plate on which the first or second closure means is fixed, the said plate being able to be moved with respect to the base or to the lid in a movement parallel to the wall thereof between a first position in which the two closure means cooperate in order to keep the lid folded over when the latter is folded over and second position in which the two closure means no longer cooperate when the lid is folded over.

2. Cap according to claim 1, wherein a spring is provided for automatically returning the plate, in the absence of external forces, to the first position.

3. Cap according to claim 1, wherein the leaf spring or springs are produced from a different material from the base.

4. Cap according to claim 1, wherein the closure means and the release means are placed opposite the hinge.

5. Cap according to claim 1, wherein a push button is placed on the base in an area that is covered by the lid when it is folded down, the push button being provided with means for actuating a valve situated on the receptacle on which the cap can be placed, the base comprising a channel terminating in a nozzle for transmitting a product emerging from a valve of the receptacle when it is actuated by the actuation means of the push button.

6. Cap according to claim 1, wherein the base is produced from polypropylene (PP) or high- or low-density polyethylene (HDPE, LDPE) and the leaf spring or springs are produced from a plastics material with a shape memory.

7. Cap according to claim 1, wherein the leaf spring or springs are produced from polyoxymethylene (POM), polyamine (PA) or polypropylene terephthalate (PPT).

* * * * *

UNITED STATES PATENT AND TRADEMARK OFFICE

CERTIFICATE OF CORRECTION

PATENT NO. : 8,505,779 B2
APPLICATION NO. : 12/593446
DATED : August 13, 2013
INVENTOR(S) : Lilienthal et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 923 days.

Signed and Sealed this
Fifteenth Day of September, 2015

Michelle K. Lee

Michelle K. Lee
*Director of the United States Patent and Trademark Office*